United States Patent [19]

Gaysert

[11] 4,163,041

[45] Jul. 31, 1979

[54] SUPPORT FOR ELASTICALLY MOUNTING A CERAMIC HONEYCOMB CATALYST

[75] Inventor: Gerhard Gaysert, Esslingen, Fed. Rep. of Germany

[73] Assignee: J. Eberspächer, Esslingen, Fed. Rep. of Germany

[21] Appl. No.: 474,163

[22] Filed: May 29, 1974

[51] Int. Cl.[2] ..... F01N 3/15; B01J 35/04; B01J 8/02

[52] U.S. Cl. ..... 422/179; 138/108; 138/112; 248/571; 248/562; 248/634

[58] Field of Search ..... 23/288 FC; 138/112, 138/108; 248/54 R, 54 CS, 204; 422/179, 180, 221

[56] References Cited

U.S. PATENT DOCUMENTS

| | | | |
|---|---|---|---|
| 2,850,366 | 9/1958 | Houdry | 23/288 FC UX |
| 2,853,368 | 9/1958 | Adey | 3/288 FC UX |
| 3,211,534 | 10/1965 | Ridgway | 23/288 FC UX |
| 3,404,965 | 10/1968 | Shiller | 23/288 FC UX |
| 3,441,381 | 4/1969 | Keith et al. | 23/288 FC |
| 3,492,098 | 1/1970 | DePalma et al. | 23/288 FC UX |
| 3,692,497 | 9/1972 | Keith et al. | 23/288 FC |
| 3,770,389 | 10/1973 | Kitzner et al. | 23/288 FC UX |
| 3,771,967 | 11/1973 | Nowak | 23/288 FC |
| 3,780,772 | 12/1973 | Carnanhan et al. | 23/288 FC UX |
| 3,785,781 | 1/1974 | Hervert et al. | 23/288 FC UX |
| 3,798,006 | 3/1974 | Balluff | 23/288 FC |
| 3,801,289 | 4/1974 | Wiley | 23/288 FC |
| 3,817,714 | 6/1974 | Wiley | 23/288 FC |
| 3,841,842 | 10/1974 | Wiley | 23/288 FC |

*Primary Examiner*—Barry S. Richman

*Attorney, Agent, or Firm*—Toren, McGeady and Stanger

[57] ABSTRACT

A support arrangement is used for elastically mounting a monolithic ceramic honeycomb structure within a housing in an exhaust gas pipe and consists of a holding angle and a molded part formed of a soft, flexible material. The holding angle is rigidly secured to the inner surface of the housing with one of its legs extending along the wall of the housing and the other extending radially inwardly from the inner housing surface. The molded part is rigidly secured to the inner end of the other leg of the holding angle and extends from its point of rigid securement in generally the same direction as but spaced inwardly from the one leg of the holding angle. At its end opposite the end secured to the holding angle, the molded part is bent radially outwardly into sliding contact with the inwardly facing surface of the holding angle. The combination of the holding angle and molded part form a cavity which may be filled with a heat-resistant material. Further, the molded part is shaped to provide a shoulder or bearing surface for one end of the catalyst and also to afford a corrugation-like indentation for absorbing expansion and contraction of the catalyst.

8 Claims, 1 Drawing Figure

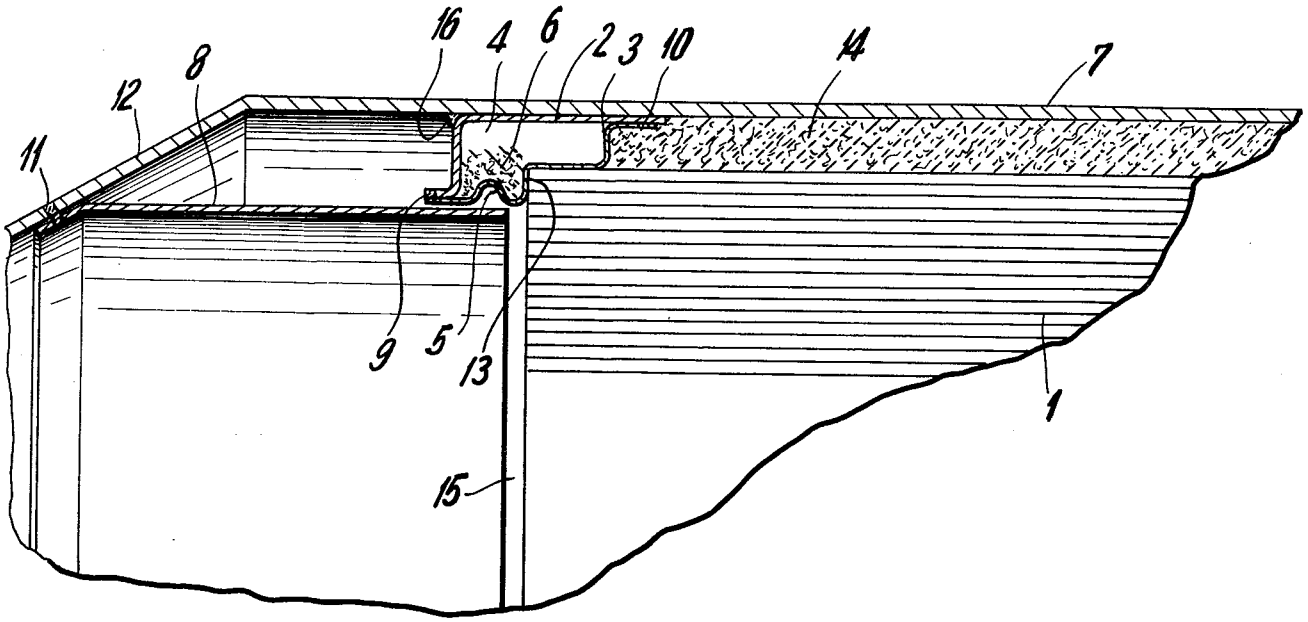
7
14
10
3
2
6
4
16
8
12
11
1
13
5
9
15

SUPPORT FOR ELASTICALLY MOUNTING A CERAMIC HONEYCOMB CATALYST

SUMMARY OF THE INVENTION

The invention is directed to a support for mounting a ceramic honeycomb catalyst in a housing within the exhaust gas pipe of an internal combustion engine, and more particularly, it concerns the formation of the support to provide an elastic mounting for the catalyst.

It is known that the exhaust gases from internal combustion engines contain harmful substances. In particular, these harmful substances include carbon monoxide, CO, unburnt or partly burnt hydrocarbons, $C_xH_y$, as well as nitric oxides, $NO_x$. These substances can be converted by chemical reaction into less harmful or harmless substances. For such conversion, catalysts have been used with great advantage. It has been found that particularly good catalysts consist of monolithic members composed of a continuous skeleton of porous ceramic material. The flow channels are formed in a honeycomb structure and usually have a square or trapezoidal cross-section with a flow area of 1 to 3 $mm^2$. As a result, a plurality of flow channels are formed which have a practically constant cross-section. Such a ceramic honeycomb structure is described in DOS Pat. No. 1,476,507. These honeycomb structures, however, have a relatively low mechanical strength and are very susceptible to stress caused by rapidly changing temperatures. The temperature of thermal expansion is considerably lower in such honeycomb structures than in the metal alloys which are used as mounting supports for the structure. Accordingly, supporting the honeycomb structures in a rigid sheet metal member presents considerable difficulties, and is frequently considered impossible. Attempts to imbed the honeycomb structure within an intermediate layer of a high-temperature resistant ceramic fiber in a metal housing have been made, but such an arrangement has not been successful. The combination of the great pulsation of the exhaust gases with dynamic alternating pressures of several tenths of an atmosphere with high gas temperatures of about 800° C., or even more, tends to destroy the ceramic fibers after only a few hours of operation. Because of these various problems, rather complicated support arrangements have been used for the honeycomb structures. All such arrangements have the disadvantage that they are complicated and because of the problems experienced in assembly tend to increase the cost of the overall arrangement appreciably.

Therefore, the present invention is directed to the provision of an elastic mounting support for a monolithic ceramic honeycomb catalyst located in a housing within the exhaust gas system of an internal combustion engine. The honeycomb catalyst and its mounting support are protected against premature destruction due to the passage of the exhaust gases over them.

In accordance with the present invention, the support arrangement consists of a rigid holding angle fixed to the interior of the housing and a molded part formed of a soft, flexible material attached to the angle. The molded part is shaped so that in combination with the holding angle it provides a cavity which is approximately box-shaped. Further, it has been found expedient in shaping the soft, flexible molded part so that a shoulder or bearing surface is formed against which the end of the honeycomb catalyst seats.

It has been found that the elastic mounting support arrangement of the present invention holds the honeycomb catalyst securely in position in a particulary simple manner. Further, the provision of the shoulder in the molded part which supports the end of the honeycomb catalyst, prevents the catalyst from becoming loose from its support during operation.

It has also been found to be of advantage if the molded part is rigidly secured to the holding angle at one side or end. As a result of this arrangement, the other side or end of the molded part is in sliding contact with the holding angle so that it adapts to longitudinal variations between the housing and the catalyst and, further, the forces effecting displacement of the catalyst can be effectively absorbed.

Further, to improve the elasticity of the support arrangement, at least one corrugation-like identation is provided in the molded part which extends parallel to the direction of flow of the exhaust gases through the catalyst. With this corrugation-like indentation, and particularly in combination with the sliding contact of the molded part with the holding angle, any major axial displacement of the honeycomb catalyst can be elastically absorbed.

When a lower degree of elasticity is required for if greater forces are to be absorbed, the approximately boxshaped cavity formed between the holding angle and the molded part can be filled with a heat-resistant material. Ceramic fibers are suitable as the filling material in the cavity.

Both to improve the flow conditions into the catalyst and to protect the support arrangement, a tubular part having its axis extending in the direction of flow of the exhaust gases is rigidly connected to the housing at a position spaced from the support arrangement and extends from that point to a position within the range of the support arrangement. The end of the tubular part within the molded part is spaced axially from the end of the catalyst supported by the molded part. Another improvement in the support arrangement can be provided by mounting the rigid holding angle in the housing under an initial axial stress. In this way a relaxation of the elastically mounted support arrangement can be achieved in the operating state.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive matter in which there is illustrated and described a preferred embodiment of the invention.

BRIEF DESCRIPTION OF THE DRAWING

The drawing is a partial sectional view of a honeycomb catalyst support arrangement embodying the present invention.

DETAILED DESCRIPTION OF THE INVENTION

In the drawing a monolithic ceramic honeycomb catalyst 1 is positioned within a tubular housing 7. The housing 7 is a part of the exhaust gas system in an internal combustion engine.

The connection of the housing 7 to the exhaust pipe, not shown, is provided by a frustoconical section 12. Though not illustrated, the housing can be divided into individual sections joined together by means of flanges to facilitate the installation of the honeycomb catalyst, however, as can be appreciated other constructions are also possible. In supporting the catalyst 1 within the housing 7, it can be elastically mounted at one end or at both ends. Where the catalyst is elastically mounted at only one end it is advantageous if the support arrangement is provided at the downstream end of the catalyst relative to the direction of flow of the exhaust gases.

The support arrangement for elastically mounting the catalyst includes a rigid ring-shaped holding angle 2 which is rigidly connected to the housing 7 by means of a weldment 16. The holding angle 2 has a first leg which extends along and in contact with the inner surface of the housing 7 and a second leg which extends radially inwardly from its juncture with the first leg being disposed transversely of the direction of flow of the exhaust gases through the housing. At its radially inner end, the second leg is bent in the opposite direction from the first leg and in generally parallel relation with the first leg so that it forms a flange-like surface. A molded part 3 formed of a soft, flexible material, is secured by a weldment 9 to the bent flange-like surface on the inner end of the second leg of the holding angle 2. The molded part 3 extends from the second leg in the axial direction of the housing and at its opposite end it is bent radially outwardly into surface contact with the inwardly facing surface of the first leg of the angle 2 and the portion contacting the first leg forms a sliding seat 10 so that the mobility or displaceability of the molded part 3 is ensured. Intermediate its point of securement to the second leg and its point of sliding contact with the first leg, the molded part is shaped so that it forms an angle-shaped bearing surface or shoulder 13 against which one end of the honeycomb catalyst 1 seats. The sliding seat 10 of the molded part 3 extends in the axial direction of the housing 7. The molded part is shaped so that, starting from its point of attachment by the weldment 9 to the inner end of the second leg, it extends first generally in the axial direction of the housing, then is bent or recessed inwardly toward the surface of the housing and is bent again to extend in the axial direction of the housing and, finally, after extending along the outer surface of the catalyst 1 it is again bent outwardly until it reaches the inwardly facing surface of the first leg of the holding angle 2 and then is bent to extend along a portion of the inwardly facing surface of the first leg. Due to the manner in which the molded part is shaped, it provides the cavity 4 with a box-shaped profile. If necessary, the cavity 4 can be filled with a heat-resistant material 6. Ceramic fibers can be used as the heat-resistant material. By utilizing a filling material in the cavity 4 it is possible to achieve a variation in the elasticity of the support arrangement.

To provide additional elasticity in the molded part, a corrugation-like indentation 5 is provided in that portion of the molded part 3 which extends between the shoulder 13 and the flange-like inner end of the second leg of the holding angle 2. The indentation 5 cooperates with the sliding seat 10 for absorbing any axial displacement of or stresses in the honeycomb catalyst 1.

A tubular part 8 is arranged within the housing 7 and is connected by the weldment 11 to the frustoconical section 12 of the housing and extends in the axial direction of the housing toward the adjacent end of the catalyst 1 into the range of the molded part 3 disposed between the shoulder 13 and the weldment 9. The tubular part acts as a shield for the support arrangement against the exhaust gases. As indicated in the drawing, the end of the tubular part 8 adjacent to the catalyst 1 is spaced from the catalyst and the shoulder 13 of the molded part 3 so that a gap 15 is provided between the tubular part and the shoulder 13 which elastically supports the catalyst. Further, the outer surface of the tubular part is spaced closely inwardly from the surface of the molded part secured to the inner end of the second leg of the angle 2. When the catalyst is assembled within the housing the gap 15 provides a separation between the end face of the honeycomb catalyst 1 and the adjacent end of the tubular part 8. Accordingly, the tubular part 8 shields the elastic mounting support arrangement against access by the exhaust gases flowing through the housing, and in particular affords protection for the radially extending second leg of the holding angle 2 and the section of the molded part 3 containing the corrugation-like indentation 5.

As shown in the drawing, the space between the axially extending outer surface of the honeycomb catalyst and the inner surface of the housing 7 is filled with an insulating material 14, for example, ceramic fiber or mineral wool.

What is claimed is:

1. A catalyst support arrangement comprising an axially extending ceramic, honeycomb catalyst having a first end and a second end each extending transversely of the axis thereof, an axially extending tubular housing laterally enclosing said catalyst and arranged to be traversed by the exhaust gases of an internal combustion engine so that the exhaust gases flow axially through said housing and over said honeycomb catalyst, said housing having an inner surface, at least one ring-shaped holding member mounted within the housing adjacent the first end of said catalyst with the axis thereof extending in generally parallel relation with the axis of said housing, wherein the improvement comprises that said holding member has an axially extending inner wall spaced radially inwardly from the inner surface of said housing, an axially extending outer wall spaced radially outwardly from said inner wall, a first end wall extending transversely of the radially inner and outer walls and located between the first end and second end of said catalyst and a second end wall spaced from said first end wall and extending transversely of said radially inner and outer walls with said second end wall spaced axially outwardly from the first end of said catalyst and with said inner and outer walls and said first and second end walls defining a closed generally box-shaped cavity, said holding member includes an annular rigid holding angle having a first leg extending in the axial direction of said housing and a second leg extending transversely of the axial direction of said housing with said second leg extending radially inwardly from said first leg and said second leg forming said second end and said first leg forming said outer wall, and a molded part formed of a soft flexible material and forming said inner wall and said first end, said molded part secured to said second leg of said holding angle and disposed in sliding contact with said first leg of said holding angle and said molded part forming a shoulder extending transversely of the axial direction of said housing and elastically supporting the first end of said catalyst.

2. A catalyst support arrangement, as set forth in claim 1, wherein a heat-resistant material fills the cavity formed by said holding angle and said molded part.

3. A catalyst support arrangement as set forth in claim 1, wherein said molded part is in contact with said holding angle in at least two locations spaced apart in the axial direction of said housing, and the portion of said molded part forming said shoulder is located intermediate said first and second end walls and said shoulder provides a bearing surface and extends in the radial direction of said ring-shaped holding member.

4. A catalyst support arrangement, as set forth in claim 3 wherein the portion of said molded part forming the inner wall is rigidly attached to the radially inner end of said second leg and the portion of said molded part forming said first end has an extension projecting angularly from the radially outer end of said first end in the axial direction of said housing toward the second end of said catalyst and disposed in sliding contact with the inwardly facing surface of the portion of said first leg of said holding angle.

5. A catalyst support arrangement as set forth in claim 3, wherein the surface of the portion of said molded part forming said inner wall extending axially from said shoulder in the direction outwardly away from the first end of said catalyst is indented in a corrugation-like form which extends toward said outer wall.

6. A catalyst support arrangement, as set forth in claim 1, wherein said second leg of said holding angle extends radially inwardly from said first leg to said molded part forming said inner wall, the radially inner end of said second leg being bent to extend in the axial direction of said housing away from the first end of said catalyst, said molded part being rigidly secured at one end to the bent radially inner end of said second leg, and the opposite end of said molded part from the portion thereof secured to said holding angle being bent from the portion thereof forming said first end wall toward the second end of said catalyst and into surface contact with the surface of said first leg of said holding angle at a position spaced from the junction of said first leg with said second leg.

7. A catalyst support arrangement, as set forth in claim 6, wherein a corrugation-like indentation is formed in said molded part with the indentation directed radially outward toward and spaced inwardly from the first leg of said holding angle and located between said shoulder and the portion of said molded part rigidly secured to said holding angle.

8. A catalyst support arrangement, as set forth in claim 7, wherein a tubular member is arranged coaxially with said ring-shaped holding member and is located radially inwardly of the inner wall of said holding member, one end of said tubular member is located in the range of said molded part adjacent the shoulder therein and outwardly from the first end of said catalyst and the other end of said tubular member extending outwardly from said second leg of said holding member and the one end of said tubular member is located between said shoulder formed by said molded part and the end of said molded part rigidly secured to said holding angle.

* * * * *